US005503499A

United States Patent [19]

Thomas et al.

[11] Patent Number: 5,503,499

[45] Date of Patent: Apr. 2, 1996

[54] IMPACT FORMED DEPRESSIONS AND INSTALLATION MACHINE

[76] Inventors: Glen E. Thomas; Amona D. Thomas, both of P.O. Box 1083, Moore Haven, Fla. 33471

[21] Appl. No.: 471,858

[22] Filed: Jun. 6, 1995

[51] Int. Cl.[6] ..... E01C 23/16

[52] U.S. Cl. ..... 404/72; 404/94; 404/133.05

[58] Field of Search ..... 404/72, 90, 93, 404/94, 15, 84.05, 133.05; 299/36–39

[56] References Cited

U.S. PATENT DOCUMENTS

| | | | |
|---|---|---|---|
| 3,094,046 | 6/1963 | Zipelius | 404/93 X |
| 4,797,025 | 1/1989 | Kennedy | 404/93 X |
| 4,802,787 | 2/1989 | Bays | 404/90 |
| 5,203,615 | 4/1993 | Zanetis et al. | 299/39 |
| 5,234,282 | 8/1993 | Osborn | 404/90 |
| 5,415,495 | 5/1995 | Johnson | 404/94 |

*Primary Examiner*—Ramon S. Britts

*Assistant Examiner*—James A. Lisehora

[57] ABSTRACT

The use of impact force to cause an impression to be transferred to an asphalt road surface in a repetitive manner to form a series of depressions. The use of hydraulic, pneumatic and gravity drop as power sources are discussed. Imprint plates having single impression or a plurality of impressions are disclosed. Various shapes for the resulting depressions are explained including a shape that matches current milled depressions. Several methods of installing the series are discussed including stationary stamping, where the machine is paused during stamping, continuous stamping and continuous machine movement with imprint plate pause relative to the surface under treatment. The latter discloses a methodology wherein the imprint plate is transferred rearward on the transport vehicle at a pace equal to the advance of the transport vehicle. Various gauging means are explained to ensure that the resulting depressions are within predetermined parameters which prevent overstamping and understamping. Multiple stamping, where a plurality of impacts are utilized for each resulting depression are explained. Installations having a continuous series and having a skip pattern incorporated therein are explained.

19 Claims, 10 Drawing Sheets

104
32
30
48
34
36
46
108
110
106

IMPACT FORMED DEPRESSIONS AND INSTALLATION MACHINE

BACKGROUND

1. Field of the Invention

The field of the invention relates to forming depressions in the surface of asphalt roads by impact impression.

2. Description of the Prior Art

Sonic noise alert pattern, (SNAP), are a series of depressions formed in the surface of asphalt. The pattern has the purpose of providing vibration, and therefore noise, when the tires of a vehicle traverse them longitudinally. Road departments use these depressions as a safety device. Longitudinally adjacent the edges of a highway or along the center line which divides the opposing directional traffic flows are common locations of placement. They act to alert a driver that his or her vehicle has extended beyond the normal driving surface. Beyond this normal driving surface many dangerous conditions exist for a vehicle traveling near the posted speed limit. These dangers include dirt or gravel shoulders, guardrail barriers, signs, mailboxes, intersecting roadways or driveways and disabled vehicles.

The various specifications for the placement and physical dimensions of the individual depressions can vary from state to state and even within a particular state. A common size and placement, used only for illustration and not limitation, places the individual depressions twelve inches apart from center of one depression to center of the adjacent depressions. The measurements of the individual depressions being seven inches from back trailing edge to front leading edge with a depth, at the deepest point, of one half inch and a lateral length across of sixteen inches. These specifications result in five inches of untreated surface between each set of adjacent depressions. Therefore, the above specifications would require fifty-two hundred and eighty depressions per mile. Limited access highways and rural roads are likely locations for SNAP depressions to be installed due to the fatigue that a driver experiences during extended driving on such roads.

A recent innovation in the specifications for the installation of SNAP depressions requires a skip pattern be incorporated within the series. One example of such a series has a repetitive cycle of eight depressions spaced as detailed above followed by an untreated area equal to the normal placement of four depressions. Such installation affords reasonable coverage of a highway while reducing the expense of installation.

Various attempts have been made to provide a machine capable of quickly, accurately, consistently and precisely installing SNAP depressions. Your applicants are aware of only one method currently known for forming such depressions. This method requires a rotary milling head to physically remove a desired amount of asphalt to form each depression.

Several machines exist capable of milling such depression utilizing a rotary cutting head. A plunge cut can be made from a stationary position to form one or more depressions per cut. A second method involves continuously advancing the cutting head while regulating the raising and lowering actions.

The primary disadvantage of milling is that material is removed by the cutting operation. Overcutting is where the rotary cutting head is allowed to penetrate further than desired. Occasionally this results in extending through the asphalt layer into the bedrock. When material is removed, water gains entry and over time erodes and weakens the rock layer. This can result in premature failure of the road.

Therefore milling has been less efficient than desired. As such, it may be appreciated that there continues to be a need for a machine that can consistently form depressions having precise placement and precise dimensions without requiring removal of material from the road surface. The present invention substantially fulfills these needs.

SUMMARY

In view of the foregoing disadvantages inherent in the known methods of installing SNAP type depressions your applicants have developed a machine capable of forming such depressions without necessitating removal of material from the road surface. The present invention is directed toward compressing asphalt material in a controlled manner to form an indentation in the road surface matching the general shape and size of current SNAP type depressions. Utilization of various gauging means, to measure either the depression being formed or a prior formed depression, are presented along with impact force adjustment means to compensate for the measured results. A unique method of moving the impact imparting member relative to the assembly to position the imprint plate stationary relative to the surface during a certain travel distance of the transport vehicle is provided.

One method involves providing an assembly having impact imparting means, an imprint plate having an impression of the desired depression, measuring means to measure travel of the assembly and triggering means to activate the impact imparting means to slam the imprint plate into the surface repetitively as determined by the measuring means. Placing the assembly on an asphalt road surface aligned with a desired path of the series of depressions. And providing transport means in the form of a transport vehicle to move the assembly along the desired path.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposed of the present invention. It is important, therefore, that the claims be regarded as including such equivalent constructions insofar as they do not depart from the spirit and scope of the present invention.

It is therefore an object of the present invention to provide a method of forming SNAP type depressions by impact means to compress and depress asphalt to form the desired impression in the road surface.

It is a further object of the present invention to eliminate the debris associated with the current milling installation of SNAP type depressions.

It is another object of the present invention to provide for an imprint pattern or a design plate having the impression of the resulting depression extending therefrom.

It is a further object of the present invention to provide for the imprint plate to have a design capable of forming either a single depression or forming multiple depressions during each impact.

An even further object of the present invention is to provide for continuously advancing the transport vehicle along the desired path of the series while installing the depressions.

Yet another object of the present invention is to provide gauging means for measuring the depth of depressions and providing impact force adjustment means to permit installation of depressions having consistent depth of penetration within the series.

Still yet another object of the present invention is to provide for blocking means to selectively prevent installation of predetermined groups of depressions to install a series having a skip pattern incorporated therein.

An even further object of the present invention is to provide for retracting the imprint plate relative to the transport vehicle so as to remain relatively stationary relative to the road surface during the stamping process.

Yet another object of the present invention is to provide for a hydraulic drive to generate the desired impact force.

Still another object of the present invention is to provide for a pneumatic drive to generate the desired impact force.

An even further object of the present invention is to provide for a gravity drop drive to generate the desired impact force.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
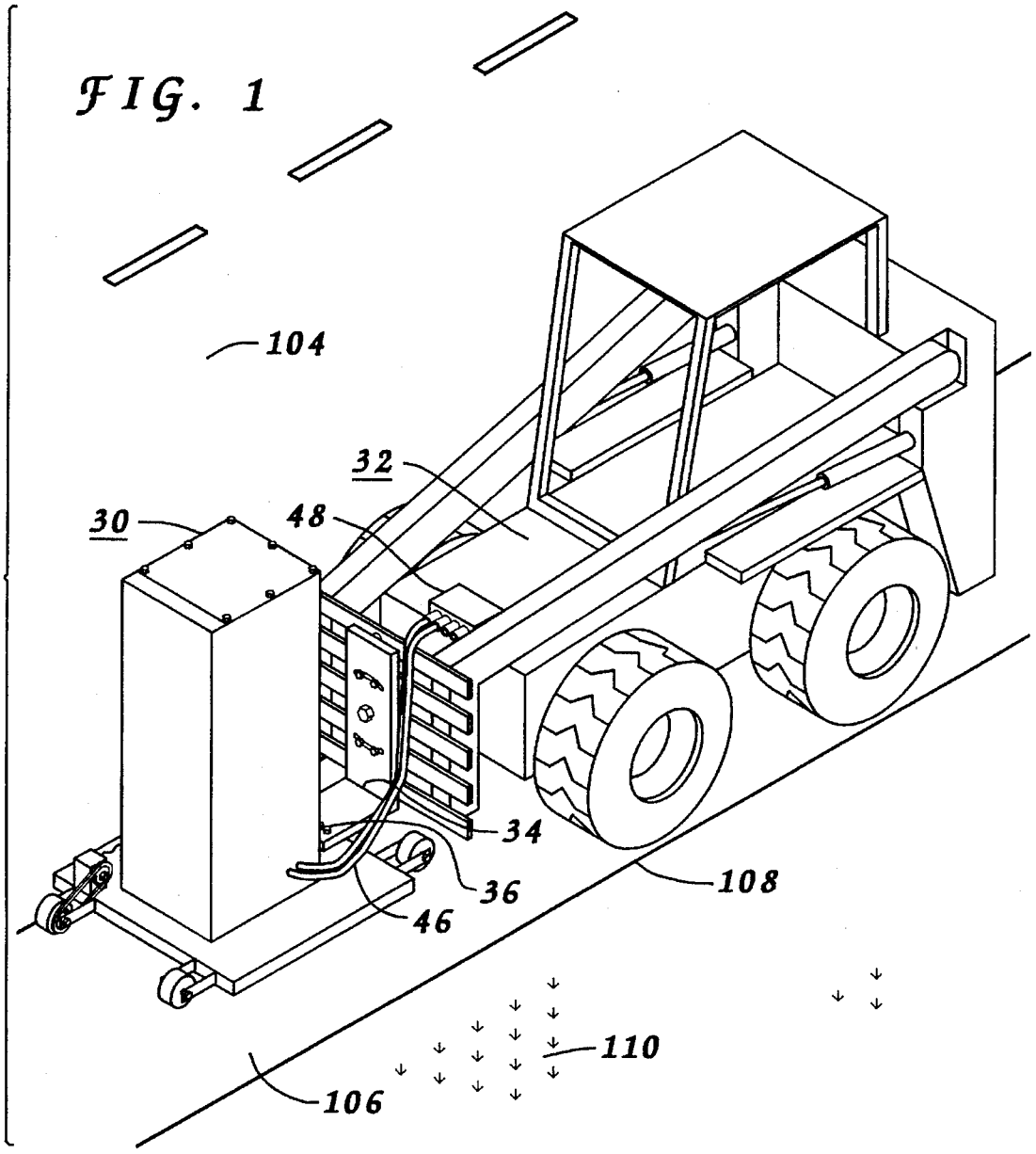
FIG. 1 is a perspective view of a stamping machine positioned on an asphalt road prior to beginning an installation procedure.
Figure 2:
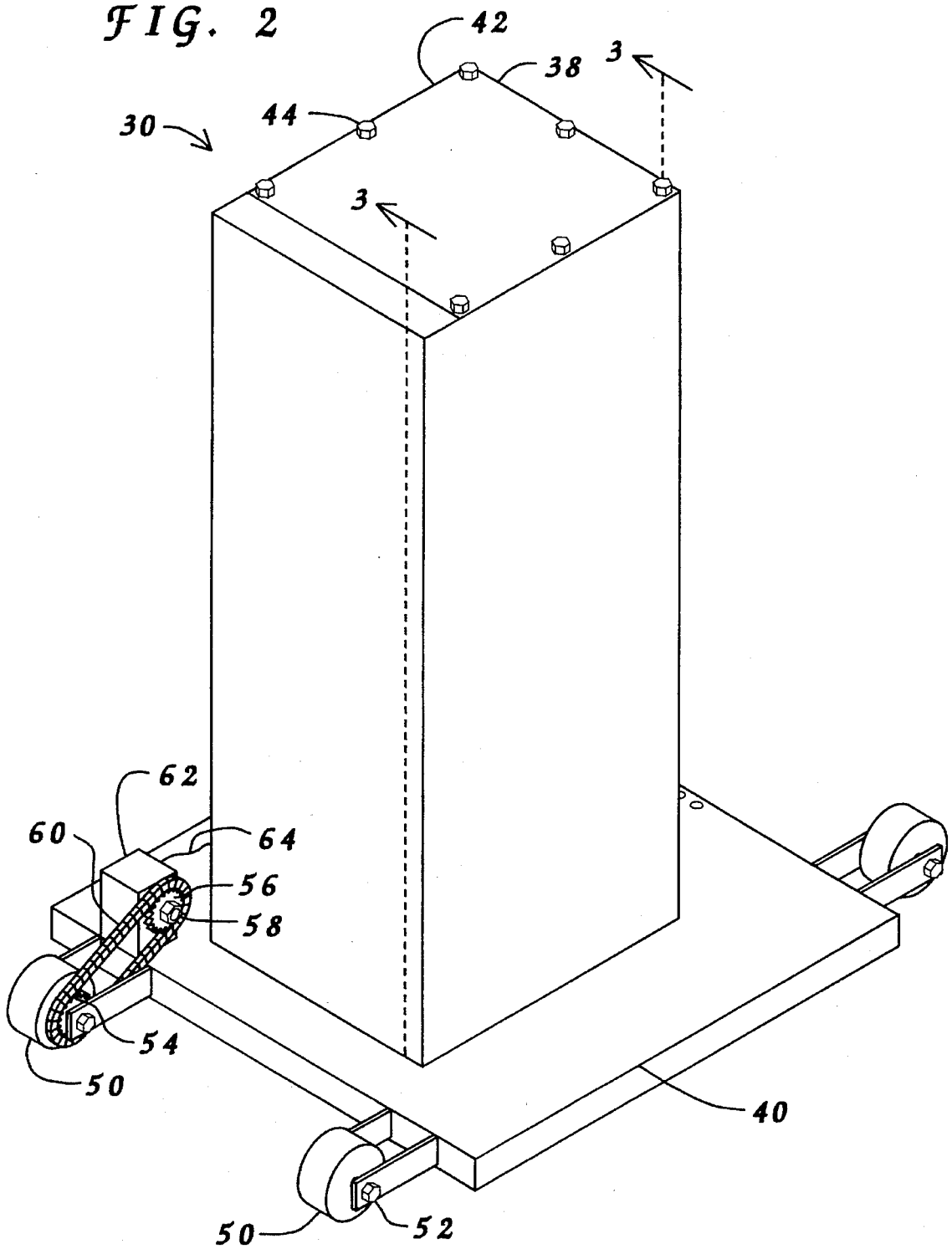
FIG. 2 is an enlarged perspective view of the stamping assembly shown in FIG. 1.
Figure 3:
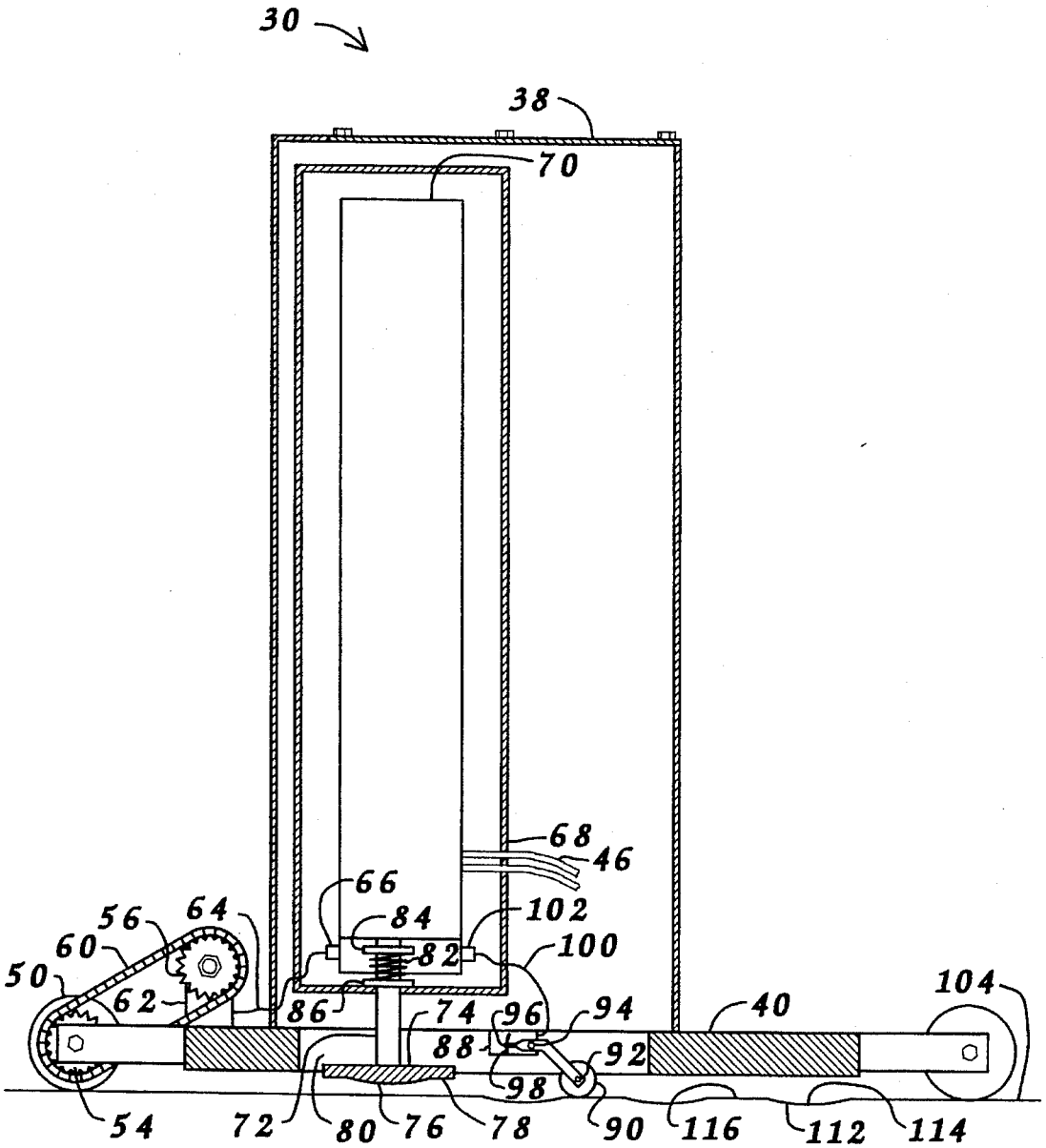
FIG. 3 is a plan section view as taken from the section lines 3 in FIG. 2.

Referring now to the drawings where like reference numerals refer to like parts throughout the various views FIG. 1, FIG. 2 and FIG. 3 show a stamping assembly 30 capable of installing depressions 112, shown in FIG. 3, in a repetitive manner to form a series of depressions. Stamping assembly 30 may be paused on surface 104 prior to a stamping operation or the assembly may be continuously advanced relative to surface 104, which is the preferred embodiment. Stamping assembly 30 is attached to a transport vehicle 32 utilizing an attachment member 34 and bolts 36. Transport vehicle 32 propels stamping assembly 30 along surface 104 being an asphalt road surface while supplying power to drive a hydraulic drive 70 shown in FIG. 3. While several different power sources are applicable, particularly expedient sources are hydraulic, air pressure and gravity drop. A hydraulic connection box 48 provides hydraulic power through hydraulic lines 46, shown in FIG. 1 and FIG. 3.

FIG. 1 illustrates placement of stamping assembly 30 on an extended edge 106 of surface 104. Extended edge 106 is bordered by a shoulder 110 and separated therefrom by an edge of pavement 108. Extended edge 106 is an area of surface 104 which is adjacent to the normal driving area and acts as a safety feature to aid in reduction of run offs by vehicles.

Stamping assembly 30, shown in FIG. 2 and FIG. 3 in more particular detail, is comprised of a housing 38 and a support plate 40. Access plate 42 is secured to housing 38 by various bolts 44 and has the purpose of providing access to a hydraulic drive housing 68 and other associative machinery. Support plate 40 has various support wheels 50 connected thereto by bolts 52. Support wheels 50 are in constant contact with surface 104 during a stamping procedure. Support plate 40 has an opening 80, shown in FIG. 3, providing access to surface 104 from within housing 38.

During the stamping procedure to install a series of depressions, hydraulic drive 70 causes an imprint plate 74 secured to a drive extension 72 to repeatedly impact surface 104 in a measured and controlled manner. Hydraulic drive 70 is conventionally known in the art. Imprint plate 74 has an impression design 76 extending downward therefrom which matches the size and shape of the resulting depression 112. Hydraulic drive 70 causes imprint plate 74 to rapidly, and with great force, impact surface 104 to form depression 112. A return spring 82 under pressure between an upper spring block 84, which is rigidly connected to drive extension 72, and a lower spring block 86 causes imprint plate 74 to immediately return to an elevated position following impact.

Timing of the impacts used to create the series is of extreme importance to ensure uniform spacing between adjacent depressions. Utilization of various timing and/or measuring means is possible. A particularly expedient methods utilizes a direct transference of a measurement of travel distance of stamping assembly 30 relative to surface 104.

A wheel gear 54 is rigidly attached to a support wheel 50 while a gear 56 is attached by a nut 58 to a control box 62. Wheel gear 54 and gear 56 are then connected utilizing a transfer chain 60. Such a coupling providing control box 62 with an extremely accurate representation of the travel of stamping assembly 30 relative to surface 104. Control box 62, as conventionally known in the art, is capable of determining a predetermined passage of travel distance and signally a triggering apparatus 66 utilizing a connection wire 64. Control box 62 is also capable of either sending continuous signals during a stamping procedure or determining and sending signals in a predetermined pattern as exampled by eight impact signals followed by a measurement without signals equal to the normal placement of four signals. Use of such a repetitive pattern of signals followed by a measurement without signals would be utilized to install a skip pattern with a series of depressions.

Control box 62 transfers a signal to triggering apparatus 66 utilizing connection wire 64 to cause hydraulic drive 70 to be activated to form depression 112. Ensuring proper depth of the resulting impression is extremely important. Understamping, where the resulting impression is not fully formed, is undesirable due to the loss of vibration generated when a vehicle traverses the series longitudinally. Overstamping, where the resulting impression has a depth greater than desired, is undesirable due to possible damage to both the upper layer as well as the base material of the road.

Several considerations exist in determining asphalt compressibility. These include the composition of the asphalt, the age of the road, the age of the upper asphalt layer, which may be different than the age of the road, the thickness of the upper asphalt layer and the prevailing weather conditions including temperature and humidity.

While numerous options exist to provide for uniform installation within predetermined variants, two particularly expedient methods are presented. The first, shown in FIG. 3, provides for selecting an impact pressure and setting hydraulic drive 70 to provide this measured impact power to impact imprint plate 74 with surface 104. In conjunction therewith a surrounding area 78 is provided to encircle impression design 76. Impression design 76 being the complete impression of depression 112, in any of the numerous designs. Surrounding area 78 would be planar or taper upward as it extends outward from impression design 76. Surrounding area 78 would provide for the even distribution of any excess impact power over a greater area thus preventing overstamping. The second provides for a determination of the status of formed depressions 112. Within this second general area two separate methods exist. The first provides for multiple impacts for each installation with a measurement between such impacts. This method is detailed in greater detail below. The second involve measuring a prior formed depression and adjusting the impact of subsequent impacts based on the measurement of the result of the prior impact.

FIG. 3 illustrates an apparatus capable of measuring a maximum depth 114 of depression 112 formed during a prior impact relative to a prevailing surface elevation 116. A wheel 90 having an axle 92 moves along surface 104 in the path of depressions 112 previously formed during the stamping procedure. As wheel 90 rolls through depression 112 maximum depth 114 is transferred to a gauging member 88 by a pivoting movement utilizing a pivotal axle 94 by moving a measuring member 96 within a measuring slot 98. As wheel 90 continues to roll during the stamping procedure a measurement for prevailing surface elevation 116 is similarly transferred to gauging member 88. Prevailing surface elevation 116, being the spacing between adjacent depressions 112, corresponds to the normal elevation of surface 104. Measuring slot 98 and measuring member 96 cooperate such that the range of movement of measuring member 96 within measuring slot 98 is transferred using a transfer wire 100 to an impact force adjuster 102. Impact force adjuster 102 then either provides the same impact force as previously delivered to form the measured depression or increases or decreases the impact force depending upon the depth of the measured depression.

Many different shapes and outlines are possible for depressions formed by a stamping procedure. A particularly expedient design allows for the formed depressions to match, relative to size, shape, depth and spacing, depressions formed by the conventional milling procedure. Additionally multiple depressions may be formed during each stamping action by placing more than one impression on the imprint plate.

Figure 4:
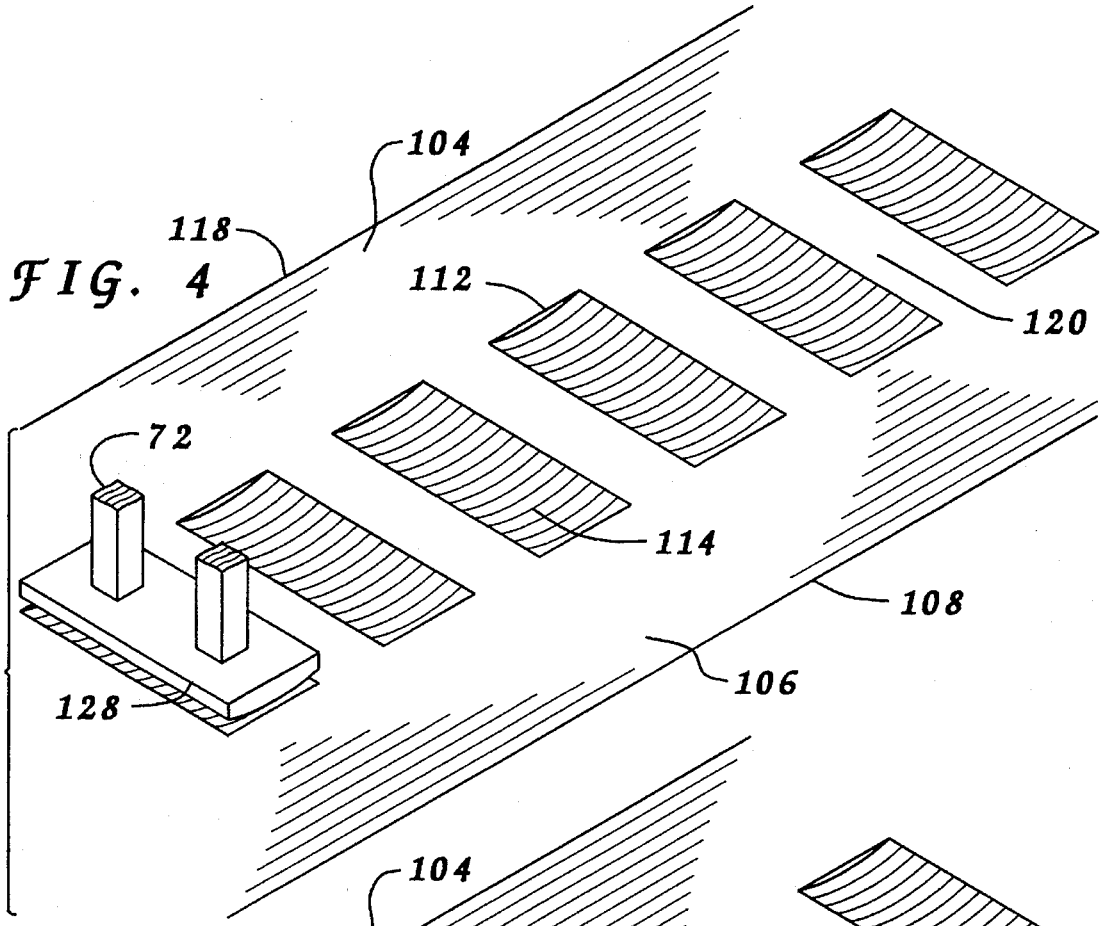
FIG. 4 is a perspective view of an imprint plate positioned with six installed depressions.
Figure 5:
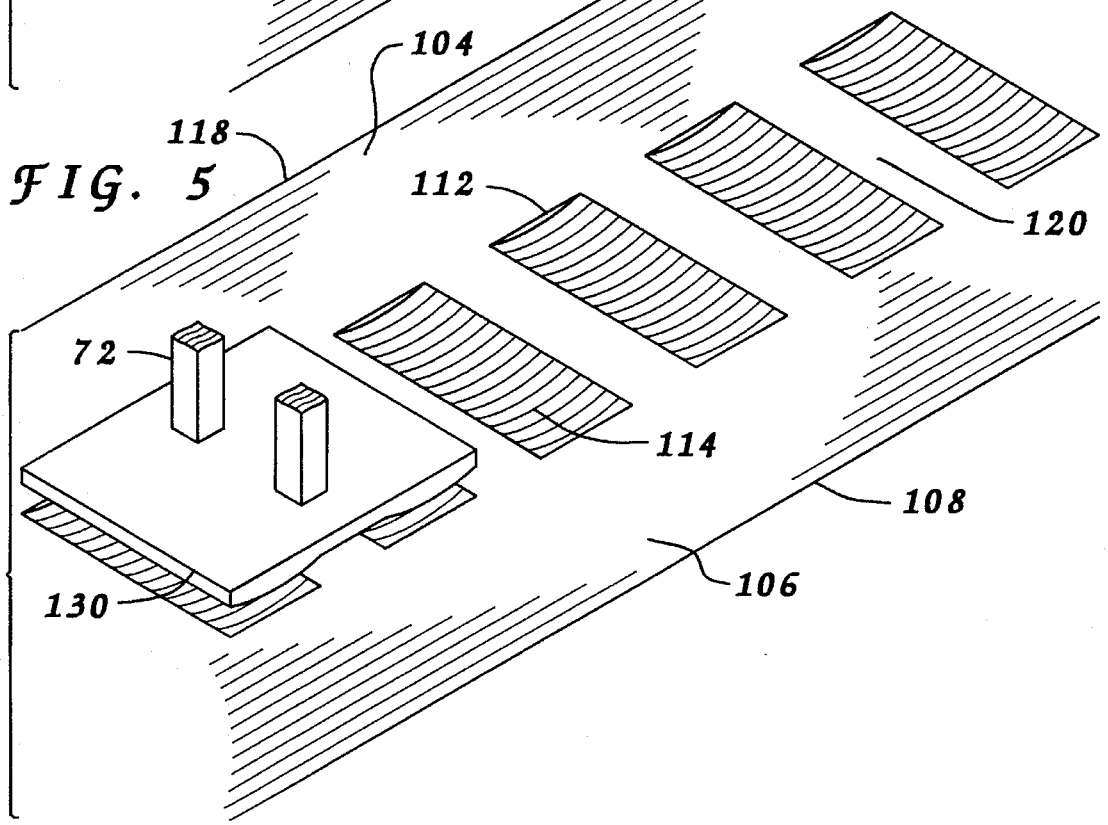
FIG. 5 is a perspective view of an imprint plate capable of installing two depressions positioned with six installed depressions.
Figure 6:
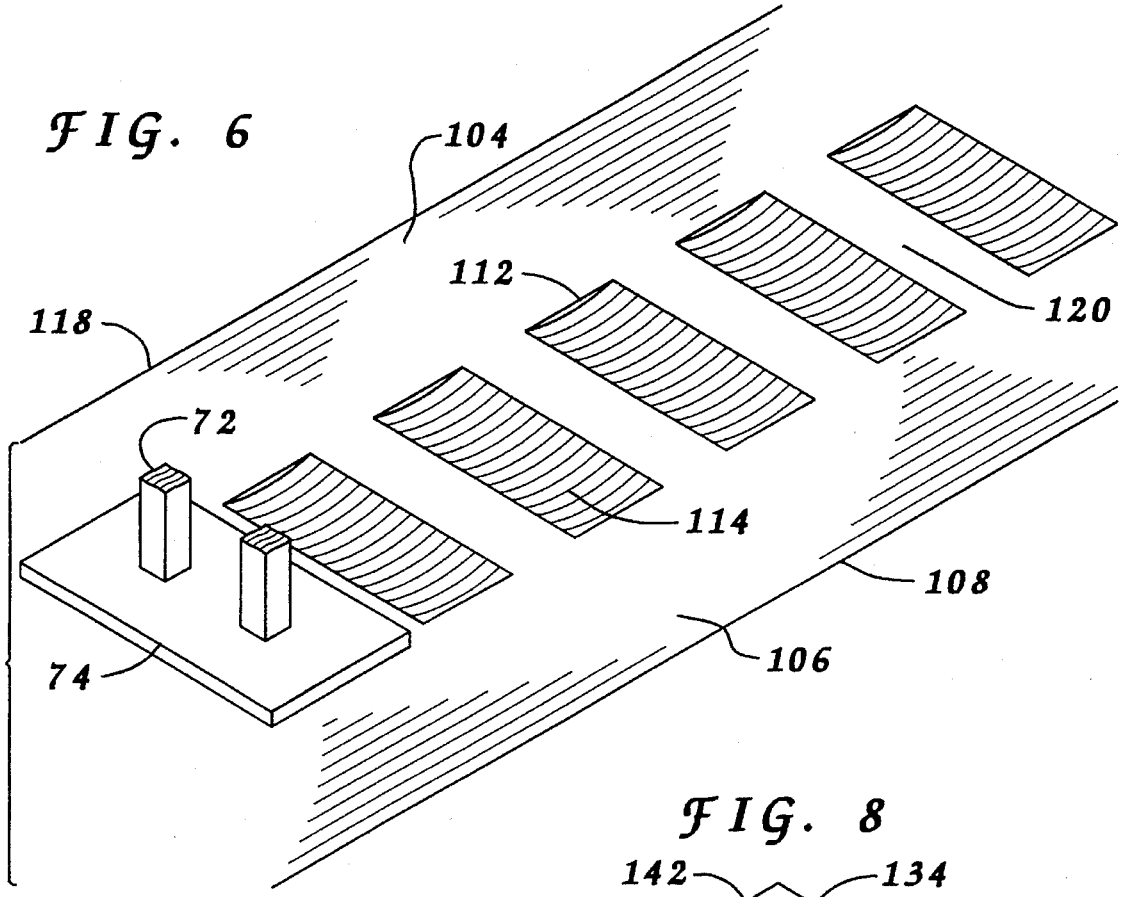
FIG. 6 is a perspective view of an imprint plate having an overlying area positioned with five visible installed depressions.

FIG. 4, FIG. 5 and FIG. 6 shows various imprint plates 128, 130 and 74 respectively with drive extensions 72 cutaway. Surface 104 is an asphalt road having extended edge 106 situated between a side marking line 118 and edge of pavement 108. Shown in each of the views are a group of formed depressions 112 each having maximum depth 114 and a separating strip 120 between adjacent depressions 112.

FIG. 4 illustrates imprint plate 128 capable of forming a single depression 112 during each impact or impact series. Impact series refers to multiple impacts used to form a single impression, whether a single depression or a plurality, and explained in detail below. It is noted that only the compressed area of asphalt is directly contacted by imprint plate 128. Overstamping is possible without impact force control while secondary compression of surface 104 adjacent depression 112 is eliminated permitting accurate measurement of the relative elevation of separating strip 120. Imprint plate 128 is also illustrated in FIG. 17 thru FIG. 20.

FIG. 5 illustrates imprint plate 130 capable of forming two depressions 112 during each impact or impact series. Depending upon the compressibility of the specific surface under treatment and the impact force available to be delivered, imprint plates having multiple impressions are possible.

Figure 7:
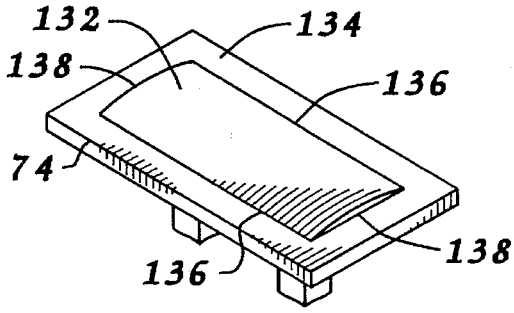
FIG. 7 is a perspective view of the bottom of the imprint plate shown if FIG. 6 having an impression of a depression.

FIG. 6 illustrates imprint plate 74, as illustrated in FIG. 3 and FIG. 7, and demonstrates the use of a surrounding area 134 to eliminate overstamping by distributing and excess impact force over a greater surface area. FIG. 7 shows imprint plate 74 having an impression 132. The design of impression 132 is used to form all depressions 112 illustrated in the various views. Impression 132 has two opposing longitudinal edges 136 and two opposing lateral edges 138. Longitudinal edges 136 are transitional and allow forming of depressions having gradual transitional leading and trailing edges, relative to the length of the series, which smoothly blend into the surrounding surface area of the road. Lateral edges 138 are sharp elevated arched structures and allow forming of depressions having sharp transitional side edges, relative to the length of the series, which have vertical sides which sharply define the resulting depression from the surrounding surface area of the road. Depressions formed by impression 132 generally match conventional milled SNAP type depressions.

Figure 8:
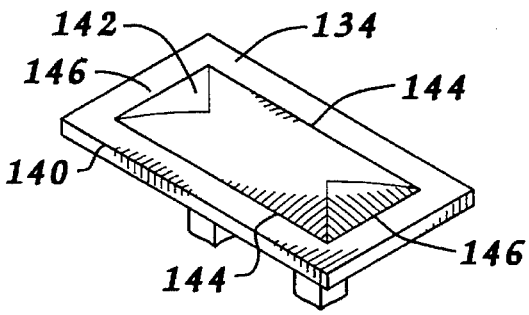
FIG. 8 is a perspective view of the bottom of an imprint plate having a second embodiment of an impression of a depression.

FIG. 8 illustrates an imprint plate 140 having an impression 142 having opposing longitudinal edges 144 and opposing lateral edges 146. Longitudinal edges 144 and lateral edges 146 are transitional and permit forming of depression having gradual transitional edges as explained above.

Figure 9:
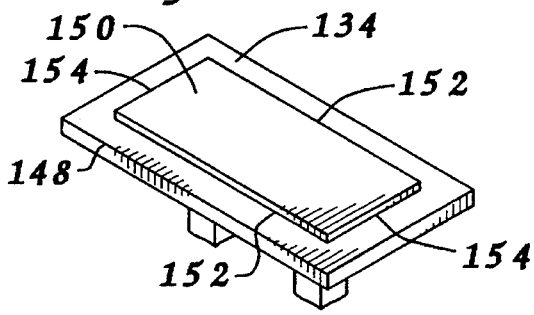
FIG. 9 is a perspective view of the bottom of an imprint plate having a third embodiment of an impression of a depression.

FIG. 9 illustrates an imprint plate 148 having an impression 150 having opposing longitudinal edges 152 and opposing lateral edges 154. Longitudinal edges 152 and lateral edges 154 are sharp elevated structures and allow forming depressions having sharply defined edges which have vertical sides which sharply define the resulting depressions. Additionally impression 150 permits depressions to be formed having a smooth planar base.

Many different designs are possible including designs which are not possible to form by conventional milling, as exampled by imprint plate 148 shown in FIG. 9 which forms depressions having a planar base. Additionally oval, triangle or other non standardized shapes are possible and would be easily installed by impact stamping.

Figure 10:
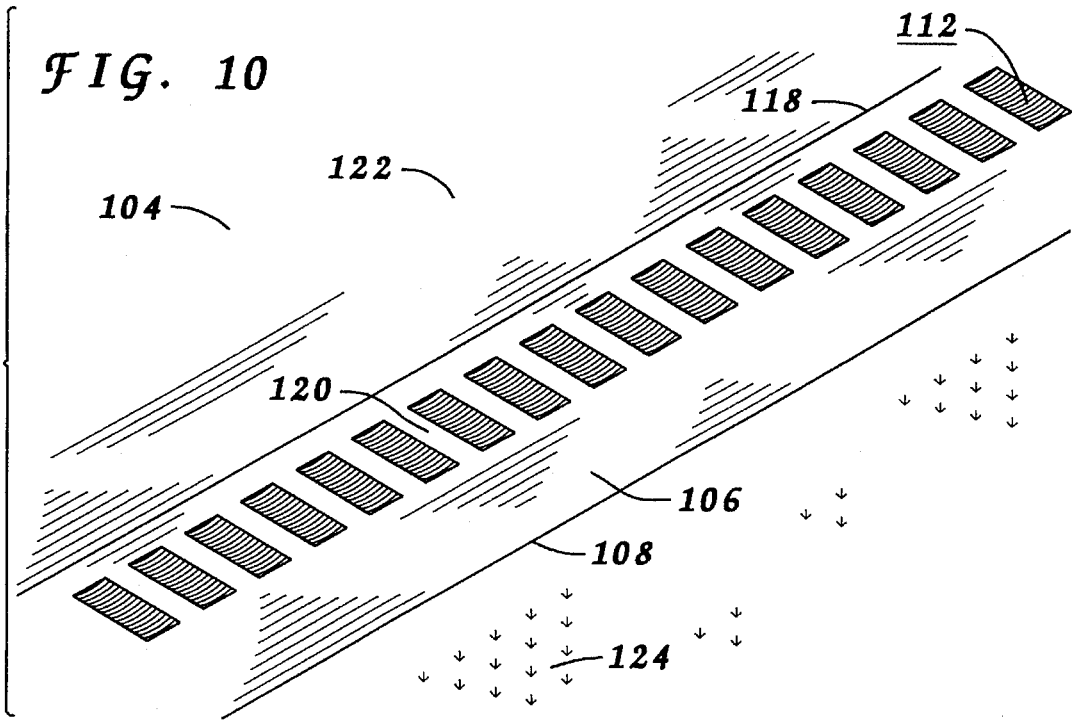
FIG. 10 is a perspective view of a continuous series of installed depressions.
Figure 11:
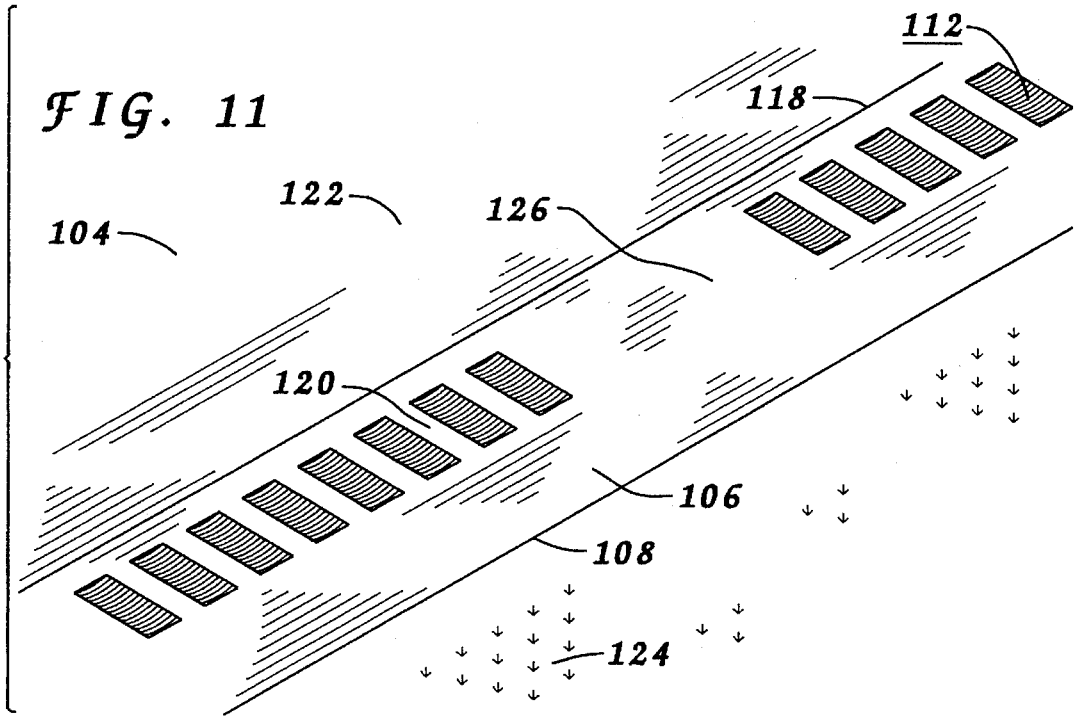
FIG. 11 is a perspective view of a series of installed depressions having a skip pattern incorporated therein.
Figure 12:
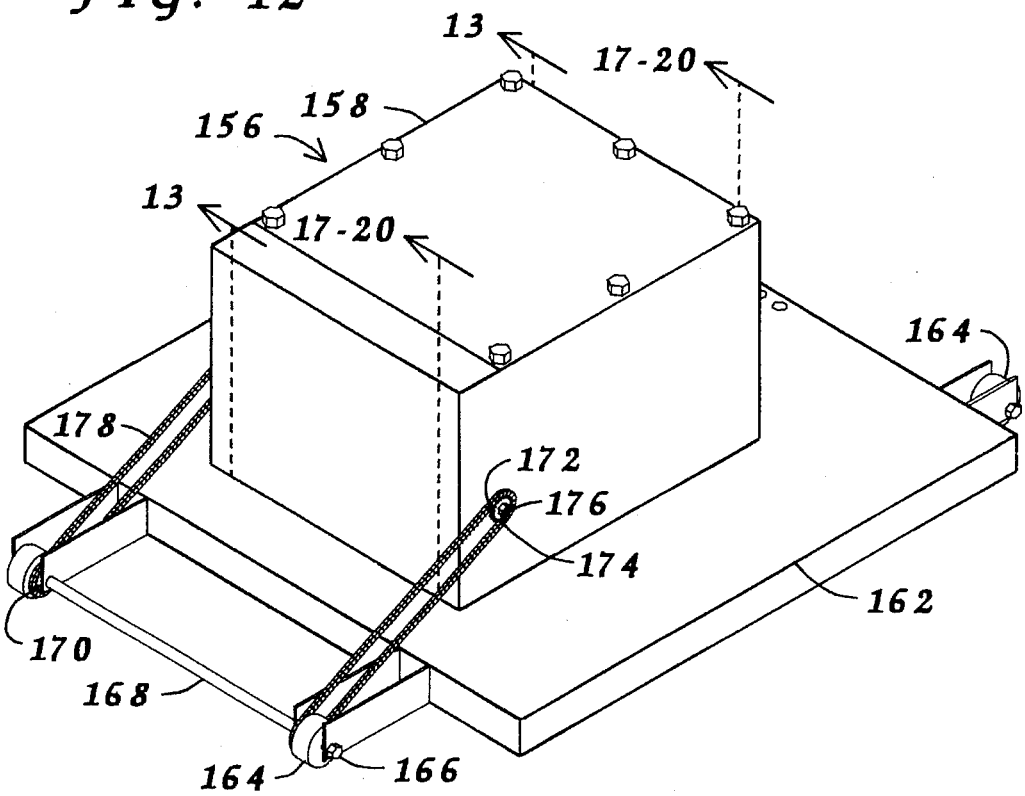
FIG. 12 is a perspective view of a second embodiment of a stamping assembly.
Figure 13:
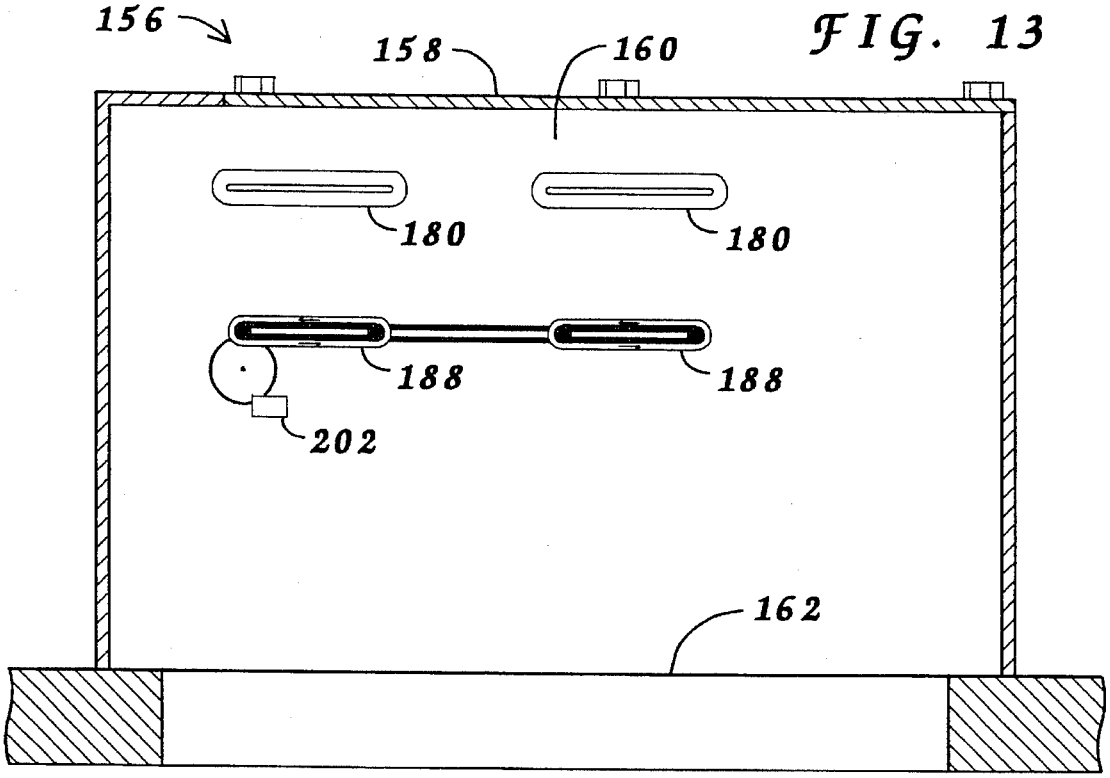
FIG. 13 is a plan sectional view as taken from the section line 13 shown in FIG. 12.

FIG. 10 and FIG. 11 illustrate two basic configurations for series of SNAP type depressions. Two basic locations on surfaces 104 exist for SNAP type depressions. The first is on extended edge 106 along the side of the road to separate driving lane 122 from edge of pavement 108. Beyond edge of pavement 108 generally lies a shoulder 124. While driving lane 122 is defined from extended edge 106 by side marking line 118, driving across side marking line 118 does not alert the vehicle operator of such passage. Adjacent depressions 112 are defined by separating strip 120 which is not compressed and has an elevation relatively equal to the surrounding area of surface 104. Depressions 112 are installed in either a continuous series, as illustrated in FIG. 10 or in a series, as illustrated in FIG. 11, having a skip section 126 incorporated therein. In this illustration skip section 126 is the normal spacing of four depressions 112. Following skip section 126 is the normal placement of eight depressions 112. This pattern is repeated in a repetitive cycle to form the series. Such edge defining placement as illustrated in FIG. 10 and FIG. 11 can be utilized to define both sides of single direction traffic flow as exampled by divided highways. The second basic location is to define directional flows on bidirectional highways along the center line.

FIG. 12 thru FIG. 20 illustrate a stamping assembly 156, or partial views therefrom, capable of installing a series of depressions 112 as illustrated in FIG. 17 thru FIG. 20. Stamping assembly 156 illustrates the use of pneumatic power to generate the impact force.

Stamping assembly 156 shows one method of providing longitudinal adjustment means. The imprint plate is moved rearward relative to the forward motion of the machine at a rate relatively equal to the speed of the machine along the road surface. The imprint plate is elevated relatively stationary above the surface during this rearward travel cycle of the imprint plate relative to the machine. Such stationary placement permits, but does not require, multiple impacts to be delivered to the same surface location during a stamping operation. Following this rearward travel cycle the imprint plate is moved forward relative to the machine prior to beginning a subsequent rearward travel cycle.

Within the longitudinal adjustment means timing, both of the rearward travel cycle as well as the timing of the impact or impacts, is of extreme importance. It is necessary to ensure that proper placement of the resulting depressions within the series to provide proper spacing within a reasonable tolerance. While several structural designs exist, including electric motors, hydraulic, pneumatic amongst others, direct linkage is a particularly expedient method. Direct linkage can easily be tied to the passage of the machine relative to the surface under treatment and accurately transfer such passage to the timing of the various required steps. Such linkage can be in direct communication with the surface via a support wheel or linked to the transport vehicle as exampled by linkage to an axle or the transmission of the transport vehicle.

Stamping assembly 156 is comprised of a housing 158 and a support plate 162 with support wheels 164 attached to support plate 162 using bolts 166. Support wheels 164 support stamping assembly 156 and are in direct communication with surface 104 under treatment, as shown in FIG. 17 thru FIG. 20. Support wheels 164 rotate relative to movement of stamping assembly 156 to surface 104. A coupling axle 168 links two support wheels 164 to rotate in a synchronized manner. Opposing wheel gears 170 transfer such rotation to opposing gears 172 utilizing transfer chains 178. Gears 172 are each secured to a transfer axle 176 using a nut 174. Transfer axles 176 penetrates housing 158 and transfers such rotation to a respective transfer gear 190. Each transfer gear 190 then communicates with a longitudinal drive 188. One transfer gear 190 also communicates with an impact control box 202.

Figure 14:
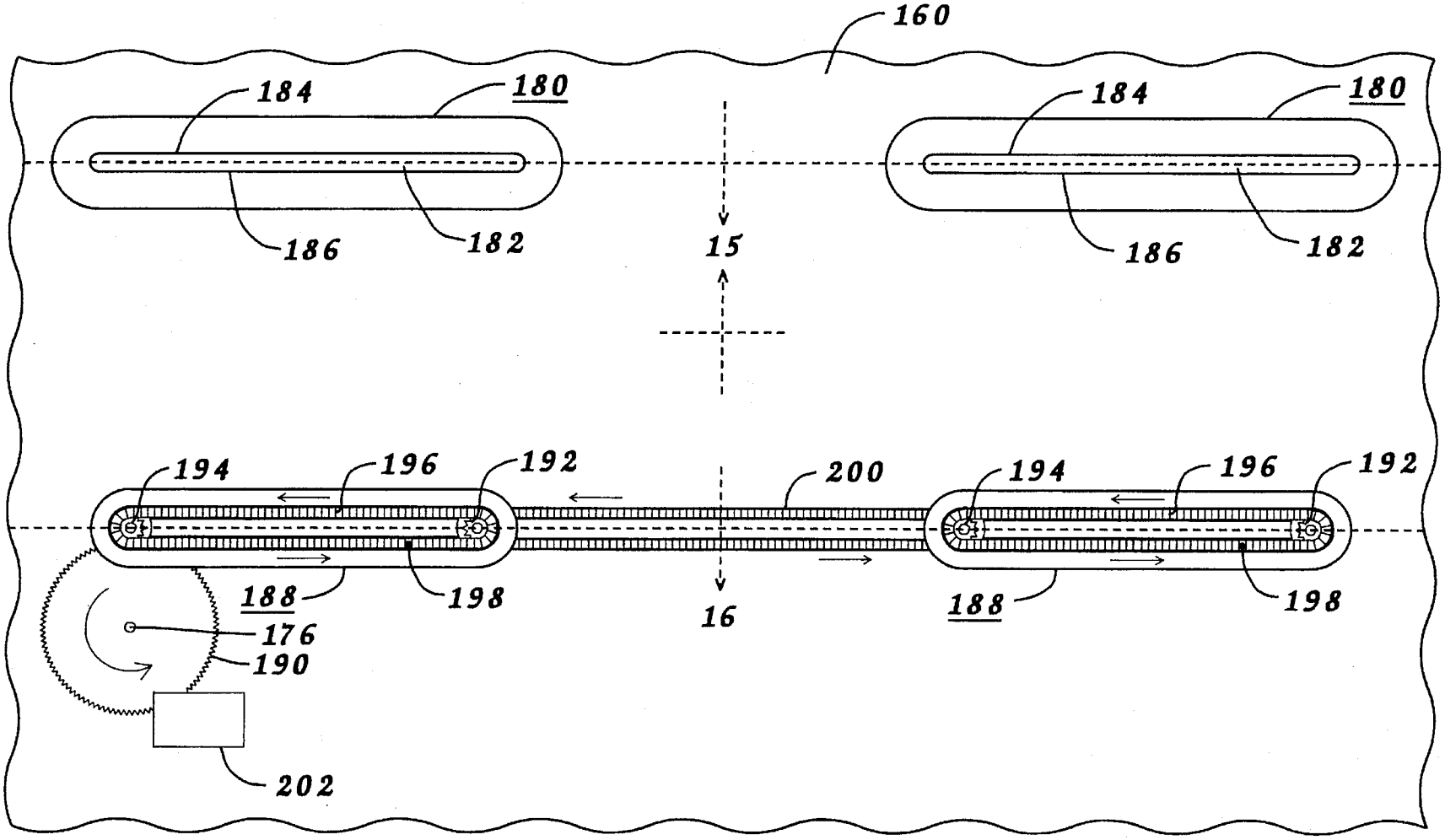
FIG. 14 a an enlarged plan view; of the support and transfer mechanism shown in FIG. 13.
Figure 15:
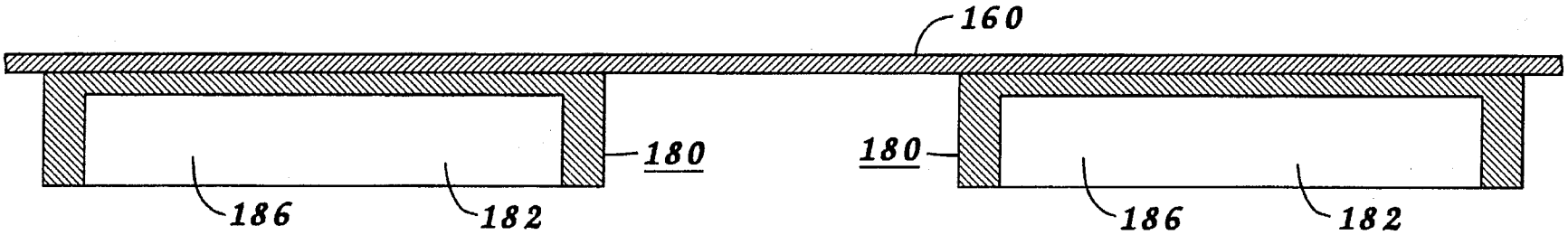
FIG. 15 is an overhead sectional view as taken from section line 15 shown in FIG. 14.
Figure 16:
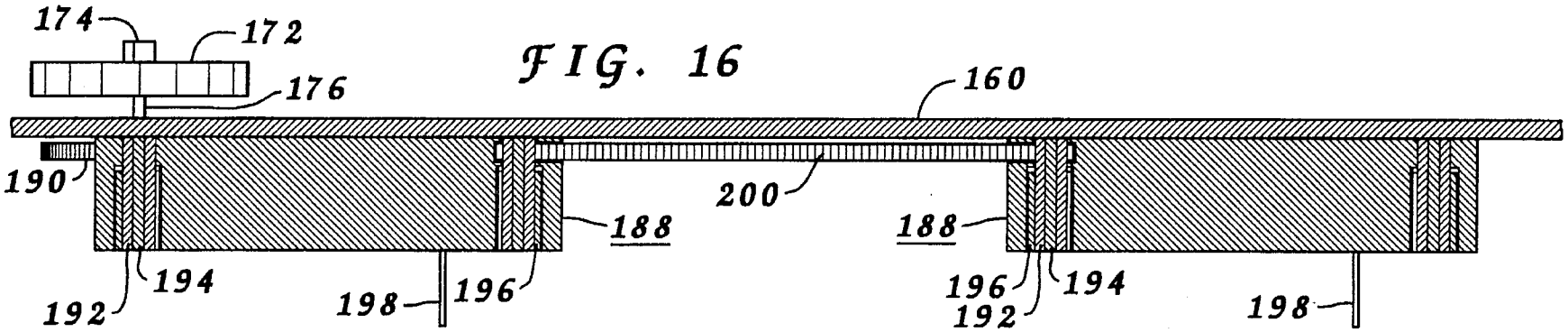
FIG. 16 is an overhead sectional view as taken from the section line 16 shown in FIG. 14.
Figure 17:
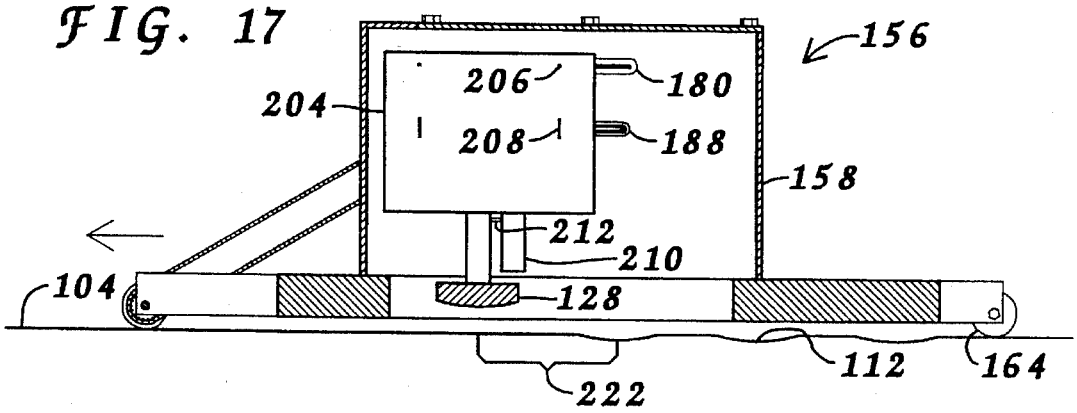
FIG. 17 through FIG. 20 are plan sectional views of a stamping procedure as taken from the section line 17–20 shown in FIG. 12.

Impact control box 202 transfers triggering instructions to cause a pneumatic drive, conventionally known in the art and not shown, contained within a pneumatic drive housing 204, to cause imprint plate 128 to impact surface 104 and form depression 112. Referring specifically to FIG. 14 and FIG. 16 gear 172, located on the outside of housing side wall 160, rotates based on the passage of stamping assembly 156. Transfer axle 176, which penetrates housing side wall 160, is linked to gear 172 and transfers such rotation to transfer gear 190. Transfer gear 190 communicates and transfers rotation to longitudinal drive 188 utilizing a drive gear 192 supported by a drive axle 194. Longitudinal drive 188 has opposing drive gears 192 which cooperate to rotate a longitudinal drive chain 196 in an endless loop. Extending from each longitudinal drive chain 196, and rigidly connected thereto, is a longitudinal drive peg 198.

The gearing ratio, having been established, is such that the passage of one unit of measurement of stamping assembly 156 along surface 104 is transferred to cause longitudinal drive peg 198 to move longitudinally forward and rearward relative to housing side wall 160 by an equal unit of measurement. Thus during the rearward travel of longitudinal drive peg 198 a stationary elevated relative position is maintained to surface 104.

A second longitudinal drive 188, having similar structure, is linked and synchronized to longitudinal drive 188 utilizing a coupling chain 200 such that two longitudinal drive pegs 198 are synchronized and move in unison.

FIG. 14 shows two drive supports 180 each having a support slot 182. Each support slot 182 has a slot upper surface 184 and a slot lower surface 186. Each drive support 180 and the assembly comprised of the two longitudinal drives 188 are secured to housing side wall 160 utilizing any conventional method known in the art. Housing 158 has two opposing housing side walls 160 which each have attached thereto the above described grouping of two drive supports 180 and the assembly comprised of two longitudinal drives 188 in elevational relationship.

FIG. 17 thru FIG. 20 illustrate a sequence of operations to install a single depression. It being noted that while imprint plate 128 has an impression capable of forming a single depression, an imprint plate capable of forming a plurality of depressions is applicable. Pneumatic drive housing 204 is shown having, in spaced relationship, two support pegs 206 and two longitudinal drive slots 208 on the visible side. The opposing side of pneumatic drive housing 204 similarly has two support pegs 206 and two longitudinal drive slots 208. Each of the four support pegs 206 rest in one drive support 180 and may slide horizontally along the length of the respective support slot 182. Each of the four longitudinal drive slots 208 has inserted therein one longitudinal drive peg 198 which may slide vertically along the height of the respective longitudinal drive slot 208. The four longitudinal drive pegs 198 are cycled along by the respective longitudinal drive chain 196 in a synchronized manner based on the movement of stamping assembly 156 over surface 104. Pneumatic drive housing 204 is supported by the four support pegs 206 resting in the four respective drive supports 180. Thus pneumatic drive housing 204 remains in a stationary elevational relationship to stamping assembly 156 while being moved forward and rearward relative to stamping assembly 156.

Figure 18:
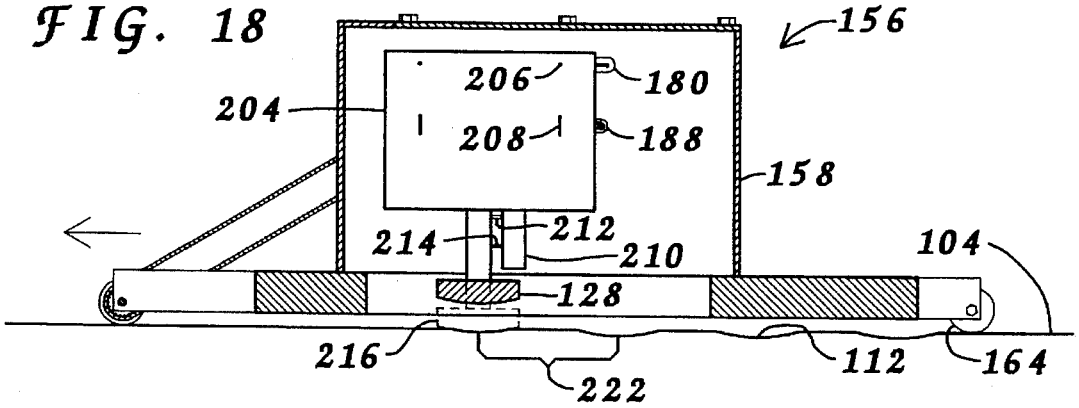
Figure 19:
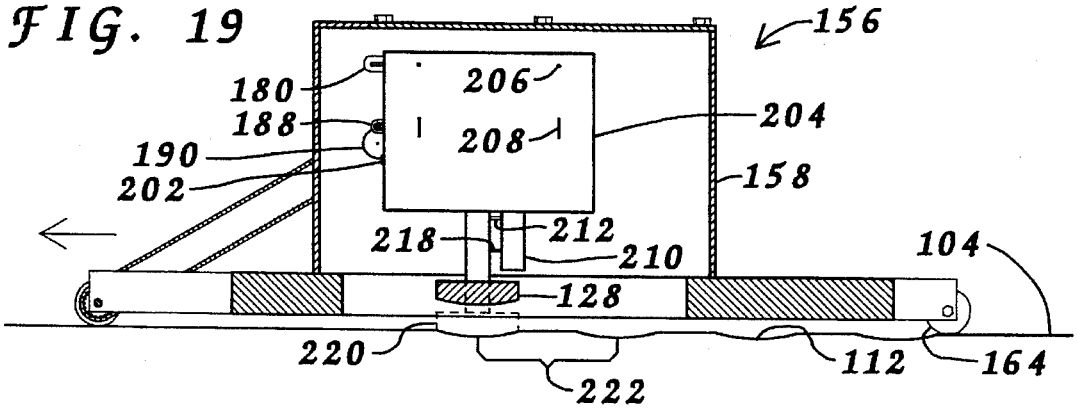
Figure 20:
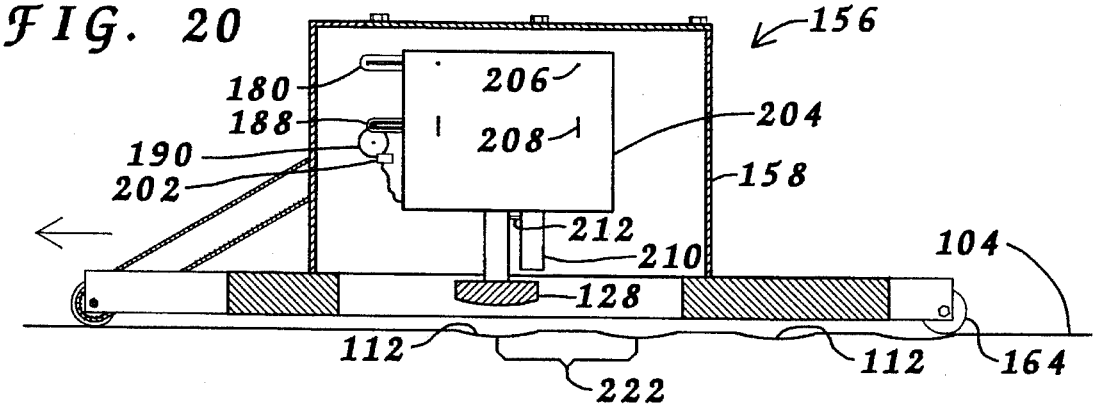

During the rearward travel of pneumatic drive housing 204 impact control box 202 causes a first impact, having a predetermined impact force, to occur as shown in FIG. 18. An impact force apparatus 210 has a depth gauge member 212 mounted to slide therein. Depth gauge member 212 is rigidly affixed to travel downward with imprint plate 128. When triggered by impact control box 202 imprint plate 128 impacts surface 104 and a first impact plate position 216 occurs. During such movement impact force apparatus 210 determines the maximum travel distance of depth gauge member 212 and records a first gauge impact position 214. In the example illustration first impact plate position 216 compression of surface 104 is insufficient to form depression 112 having a proper depth. Impact force apparatus 210 records first impact plate position 216 and causes a second, impact force adjusted, impact to occur capable of completing the compression of surface 104 to form depression 112 having the proper depth. FIG. 19 illustrates a second impact plate position 220 and a corresponding second gauge impact position 218 which is transferred to impact force apparatus 210. It being noted that while stamping assembly 156 has advanced along surface 104 pneumatic drive housing 204 has remained stationary relative to surface 104.

Pneumatic drive housing 204 is supported by the four support pegs 206 resting on slot lower surface 186 in the respective four drive supports 180. During impact, when pneumatic drive housing 204 is forced upward as a result of the powerful impact force, the four slot upper surfaces 184 of the four drive supports 180 restrict movement of pneumatic drive housing 204. Thus it is clear that longitudinal drive pegs 198 do not support pneumatic drive housing 204 nor absorb any vertical impact force.

The example specifications for SNAP depressions which have a center to center spacing of twelve inches between adjacent depressions, as represented by desired spacing 222. Pneumatic drive housing 204 would complete a cycle once every twelve inches. The series shown in FIG. 17 thru FIG. 20 being half of the complete cycle with the forward advance of pneumatic drive housing 204 not shown.

Impact control box 202 could be configured so as to incorporate a skip pattern into the stamping procedure and selectively block the triggering of impacts during a predetermined number of cycles.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications, combinations and changes will readily occur to those skilled in the art, it is not desired to limit the invention to the exact construction and operation shown and described, and accordingly, all suitable modifications and equivalents may be resorted to, falling with the scope of the invention.

We claim:

1. A method for forming a series of depressions along a desired path in an asphalt road surface, the method comprising the steps of;

a) providing an assembly having;

1) an imprint plate having a design, the design capable of forming at least one of the depressions;

2) impact imparting means, the impact imparting means to cause the design of the imprint plate to strike the asphalt road surface;

3) measuring means, the measuring means to determine a predetermined passage of distance of travel of the assembly along the desired path of the series of depressions;

4) triggering means, the triggering means activating the impact imparting means, the triggering means regulated by the measuring means;

b) placing the assembly on the asphalt road surface aligned with the desired path of the series of depressions;

c) providing transport means to move the assembly along the desired path of the series of depressions;

whereby the measuring means would selectively activate the triggering means to cause the impact imparting means to cause the design of the imprint plate to strike the asphalt road surface to form at least one of the depressions in the series in a repetitive manner to form the series of depressions.

2. The method defined in claim 1 further comprising the step of pausing the assembly at successive predetermined positions along the desired path of the series of depressions as determined by the measuring means prior to activation of the triggering means to cause the impact imparting means to cause the imprint plate to strike the asphalt road surface whereby the assembly would be stationary relative to the surface at the moment of forming each of the depressions within the series of depressions.

3. The method defined in claim 1 wherein the assembly is continuously moved longitudinally along the desired path of the series of depression utilizing the transport means during the forming of the series of depressions.

4. The method defined in claim 1 wherein the transport means comprises a self propelled vehicle and the self propelled vehicle is continuously moved longitudinally along the desired path of the series of depression during the forming of the series of depressions and the method further comprises the step of pausing the assembly at successive predetermined positions along the desired path of the series of depressions as determined by the measuring means prior to activation of the triggering means to cause the impact imparting means to cause the imprint plate to strike the asphalt road surface whereby the self propelled vehicle would continuously move along the desired path of the series of depressions and the assembly would be stationary relative to the surface at the moment of forming each of the depressions within the series of depressions.

5. The method defined in claim 1 wherein the design of the imprint plate forms one depression each time that the imprint plate strikes the asphalt road surface.

6. The method defined in claim 1 wherein the design of the imprint plate forms a plurality of depressions each time that the imprint plate strikes the asphalt road surface.

7. The method defined in claim 1 wherein each of the depressions in the series of depressions have forward and rearward transitional edges and sharp first and second side edges.

8. The method defined in claim 1 wherein each of the depressions in the series of depressions have forward, rearward, first side and second side transitional edges.

9. The method defined in claim 1 wherein each of the depressions in the series of depressions have forward, rearward, first side and second side sharp edges.

10. The method defined in claim 1 wherein the imprint plate further comprises;

a) a depth line, the depth line surrounding the design and corresponding to a predetermined penetration depth of the asphalt road surface;

b) an overlie area, the overlie area surrounding and extending from the depth line;

whereby the overlie area would prevent overstamping by the imprint plate.

11. The method defined in claim 1 further comprising the step of providing activation blocking means, the activation blocking means to selectively prevent the imprint plate from being caused to strike the asphalt road surface in a respective series, the activation blocking means regulated by the measuring means; whereby a skip pattern in formed in the series of depressions.

12. A depression stamping machine for forming a series of depressions while the machine continuously moves along a desired path, the machine to make indentations in a road surface to form a series of depressions along the desired path, the machine comprising;

a) transport means, the transport means providing transit means to continuously move the machine along the desired path during the forming of the series of depressions;

b) a housing, the housing carried by the transport means and propelled along a desired path by the transport means;

c) an imprint plate, the imprint plate having an impression of at least one of the depressions extending downward therefrom, the imprint plate attached to the housing;

d) impact imparting means, the impact imparting means to provide selective repetitive impact generation to the imprint plate to cause the imprint plate to impact the road surface;

e) measuring means, the measuring means to determine a predetermined travel distance of the housing relative to the road surface, the predetermined travel distance related to a longitudinal spacing between adjacent depressions in the series;

f) activation means, the activation means controlled by the measuring means, the activation means causing the impact imparting means to cause the imprint plate to impact the road surface;

whereby the machine forms the series of depressions by a repetitive series of impacts by the imprint plate while the machine continuously moving along the desired path.

13. The machine defined in claim 12 further comprising;

a) impact depth gauging means, the impact depth gauging means to compare a predetermined desired depth measurement with a maximum depth of a prior formed depression to obtain a comparison, the possible comparisons consisting of;

1) an ideal depth measurement, the ideal depth measurement within a predetermined measurement of the desired depth measurement;

2) a lesser depth measurement, the lesser depth measurement less than a predetermined measurement of the desired depth measurement;

3) a greater depth measurement, the greater depth measurement greater than a predetermined measurement of the desired depth measurement;

b) impact force adjustment means, the impact force adjustment means to cause the impact imparting means to deliver an adjusted controlled impact force relative to a prior impact force, the possible adjusted controlled impact forces consisting of;

1) a similar impact force, the similar impact force imposed in response to the ideal depth measurement of the comparison, the similar impact force equal to the prior impact force;

2) an increased impact force, the increased impact force imposed in response to the lesser depth measurement of the comparison, the increased impact force a predetermined amount greater than the prior impact force;

3) a decreased impact force, the decreased impact force imposed in response to the greater depth measurement of the comparison, the decreased impact force a predetermined amount lesser than the prior impact force;

whereby a sampling is continuously taken of formed depressions to determine the depth of forming and adjustment is made in the impact force to maintain a predetermined variation in the depth of formed depressions.

14. The machine defined in claim 12 wherein the impact imparting means comprises a hydraulic drive.

15. The machine defined in claim 12 wherein the impact imparting means comprises a pneumatic drive.

16. A depression stamping machine for forming a series of depressions while the machine continuously moves along a desired path, the machine to make indentations in a road surface to form a series of depressions along the desired path, the machine comprising;

a) transport vehicle, the transport vehicle providing transit means to continuously move the machine along the desired path during the forming of the series of depressions;

b) a housing, the housing carried by the transport vehicle and propelled along a desired path by the transport vehicle;

c) measuring means, the measuring means to determine a predetermined travel distance of the housing relative to the road surface, the predetermined travel distance related to a longitudinal spacing between adjacent depressions in the series;

d) an imprint plate, the imprint plate having an impression of at least one of the depressions extending downward therefrom, the imprint plate attached to the housing, the imprint plate having a forward relative position, a rearward relative position, the forward and rearward relative positions corresponding to positions along the longitudinal length of the transport vehicle;

e) longitudinal adjustment means, the longitudinal adjustment means to transfer the imprint plate alternating back and forth between the forward relative position and the rearward relative position, the travel time from the forward relative position to the rearward relative position and back to the forward relative position equal to the predetermined travel distance of the measuring means, the imprint plate relatively stationary to the road surface during transfer from the forward relative position to the rearward relative position;

f) impact imparting means, the impact imparting means to provide selective repetitive impact generation to the imprint plate to cause the imprint plate to impact the road surface at least once during each transfer of the imprint plate from the forward relative position to the rearward relative position;

g) activation means, the activation means controlled by the measuring means, the activation means causing the impact imparting means to cause the imprint plate to impact the road surface;

whereby the machine continuously moves along the desired path while the imprint plate is drawn rearward relative to the transport vehicle at about the same speed as the transport vehicle is travelling forward with the imprint plate remaining relatively stationary to the road surface while the imprint plate impacts the road surface to transfer the impression in a repetitive manner to form the series of depressions.

17. The machine defined in claim 16 wherein a plurality of impacts of the imprint plate is caused by the impact imparting means during each transfer of the imprint plate from the forward relative position to the rearward relative position.

18. The machine defined in claim 17 wherein the plurality of impacts comprises a first impact and at least one subsequent impact and the machine further comprises;

a) gauging means, the gauging means to determine a depth of installation of the first impact;

b) impact force adjustment means, the impact forte adjustment means to adjust the subsequent impact to facilitate installation of a depression having a predetermined desired depth of installation;

whereby a first impact is gauged and at least one subsequent impact, having an adjusted force of impact, is delivered to install a depression having a desired depth.

19. The machine defined in claim 16 wherein the longitudinal adjustment means comprises a chain drive member.

* * * * *